US005626817A

United States Patent [19]

Sawaragi et al.

[11] Patent Number: 5,626,817

[45] Date of Patent: May 6, 1997

[54] AUSTENITIC HEAT RESISTANT STEEL EXCELLENT IN ELEVATED TEMPERATURE STRENGTH

[75] Inventors: Yoshiatsu Sawaragi; Hiroyuki Senba, both of Nishinomiya, Japan

[73] Assignee: Sumitomo Metal Industries, Ltd., Osaka, Japan

[21] Appl. No.: 494,736

[22] Filed: Jun. 26, 1995

[30] Foreign Application Priority Data

Jun. 28, 1994 [JP] Japan ..... 6-146438

[51] Int. Cl.[6] ..... C22C 38/42

[52] U.S. Cl. ..... 420/49; 420/60; 420/61

[58] Field of Search ..... 420/49, 584.1, 420/60, 61; 148/327

[56] References Cited

FOREIGN PATENT DOCUMENTS

| | | |
|---|---|---|
| 853481 | 8/1977 | Belgium . |
| 2314661 | 10/1973 | Germany . |
| 58-120766 | 7/1983 | Japan . |
| 61-166953 | 7/1986 | Japan . |
| 62-133048 | 6/1987 | Japan . |
| 6-142980 | 5/1994 | Japan . |
| 278886 | 2/1970 | Sweden . |
| 1574101 | 9/1980 | United Kingdom . |

*Primary Examiner*—Deborah Yee

*Attorney, Agent, or Firm*—Burns, Doane, Swecker & Mathis, LLP

[57] ABSTRACT

A heat resistant austenitic stainless steel having high strength at elevated temperatures. The steel consists of 0.05 to 0.15% carbon, not more than 0.5% silicon, 0.05 to 0.50% manganese, 17 to 25% chromium, 7 to 20% nickel, 2.0 to 4.5% copper, 0.10 to 0.80% niobium, 0.001 to 0.010% boron, 0.05 to 0.25% nitrogen, 0.003 to 0.030% sol.aluminum, 0 to 0.015% magnesium and the balance being iron and incidental impurities. The steel may contain 0.3 to 2.0% molybdenum and/or 0.5–4.0% tungsten. The steel exhibits high creep rupture strength at elevated temperatures for long periods of time, and can be produced at low cost. The steel is suitable for use in the structural members for boilers, chemical plants and other installations operated in a high temperature environment.

12 Claims, 2 Drawing Sheets

AUSTENITIC HEAT RESISTANT STEEL EXCELLENT IN ELEVATED TEMPERATURE STRENGTH

FIELD OF THE INVENTION

This invention relates to an austenitic heat resistant steel having high strength at elevated temperatures, and which is suitable for use in structural members for apparatus and installations which are operated at elevated temperatures.

DESCRIPTION OF THE PRIOR ART 18-8 austenitic stainless steels, such as JIS (Japanese Industrial Standard) SUS 304H, SUS 316H, SUS 321H and SUS 347H have been used for structural members in boilers, chemical plants and other apparatus and installations which are operated in a high temperature environment. In recent years, these apparatus and installations have been required to operate in severer conditions and environments. Accordingly, the structual materials have been required to exhibit more improved physical and chemical properties as compared with the conventional 18-8 austenitic stainless steels which do not have sufficient strength at elevated temperatures for such uses.

In general, using both precipitation of carbonitrides and solid solution hardening by addition of considerable amounts of molybdenum and tungsten is effective for improving strength of austenitic stainless steel at high temperatures. However, in the case of adding large amounts of molybdenum and tungsten, the addition of large amounts of nickel is required in order to ensure a stable structure of austenitic phase. Neverthless, nickel is extremely expensive, thus raising the steel production costs.

An object of this invention is to provide a heat resistant austenitic steel having superior strength at high temperatures and can withstand severe operating conditions at elevated temperatures.

Another object of this invention is to provide economical heat resistant austenitic steel which replaces expensive alloying elements with inexpensive alloying elements whereby the use of costly alloying elements is limited as much as possible.

One of the inventors of this invention, has already proposed nitrogen containing austenitic steels with excellent elevated temperature strength and stable microscopic structure (see Japanese Patent Public Disclosure, JPPD 62-133048). The steel contains some elements such as copper, boron and magnesium which are effective for improving the creep rupture strength. Furthermore, the use of silicon and aluminum contents is suppressed in the above-mentioned steel.

After having conducted further studies, the inventors discovered that in an austenitic stainless steel containing copper, niobium and nitrogen, an increase of creep rupture strength at a higher temperature range for long periods of time can be achieved by suppressing the manganese content to be not more than 0.5%.

SUMMARY OF THE INVENTION

The present invention has been made on the basis of the above-mentioned findings and relates to austenitic stainless steels (1) and (2), as follows:

(1) A heat resistant austenitic stainless steel having high strength at elevated temperatures, consisting of, on the weight percent basis, 0.05 to 0.15% carbon, not more than 0.5% silicon, 0.05 to 0.50% manganese, 17 to 25% chromium, 7 to 20% nickel, 2.0 to 4.5% copper, 0.10 to 0.80% niobium, 0.001 to 0.010% boron, 0.05 to 0.25% nitrogen, 0.003 to 0.030% sol. aluminum, 0 to 0.015% magnesium and the balance being iron and incidental impurities.

(2) A heat resistant austenitic stainless steel having high strength at elevated temperatures, consisting of, on the weight percent basis, 0.05 to 0.15% carbon, not more than 0.5% silicon, 0.05 to 0.50% manganese, 17 to 25% chromium, 7 to 20% nickel, 2.0 to 4.5% copper, 0.10 to 0.80% niobium, 0.001 to 0.010% boron, 0.05 to 0.25% nitrogen, 0.003 to 0.030% sol. aluminum, 0 to 0.015% magnesium, one or both of 0.3 to 2.0% molybdenum and 0.5 to 4.0% tungsten, and the balance being iron and incidental impurities.

DETAILED DESCRIPTION OF THE INVENTION

Figure 1:
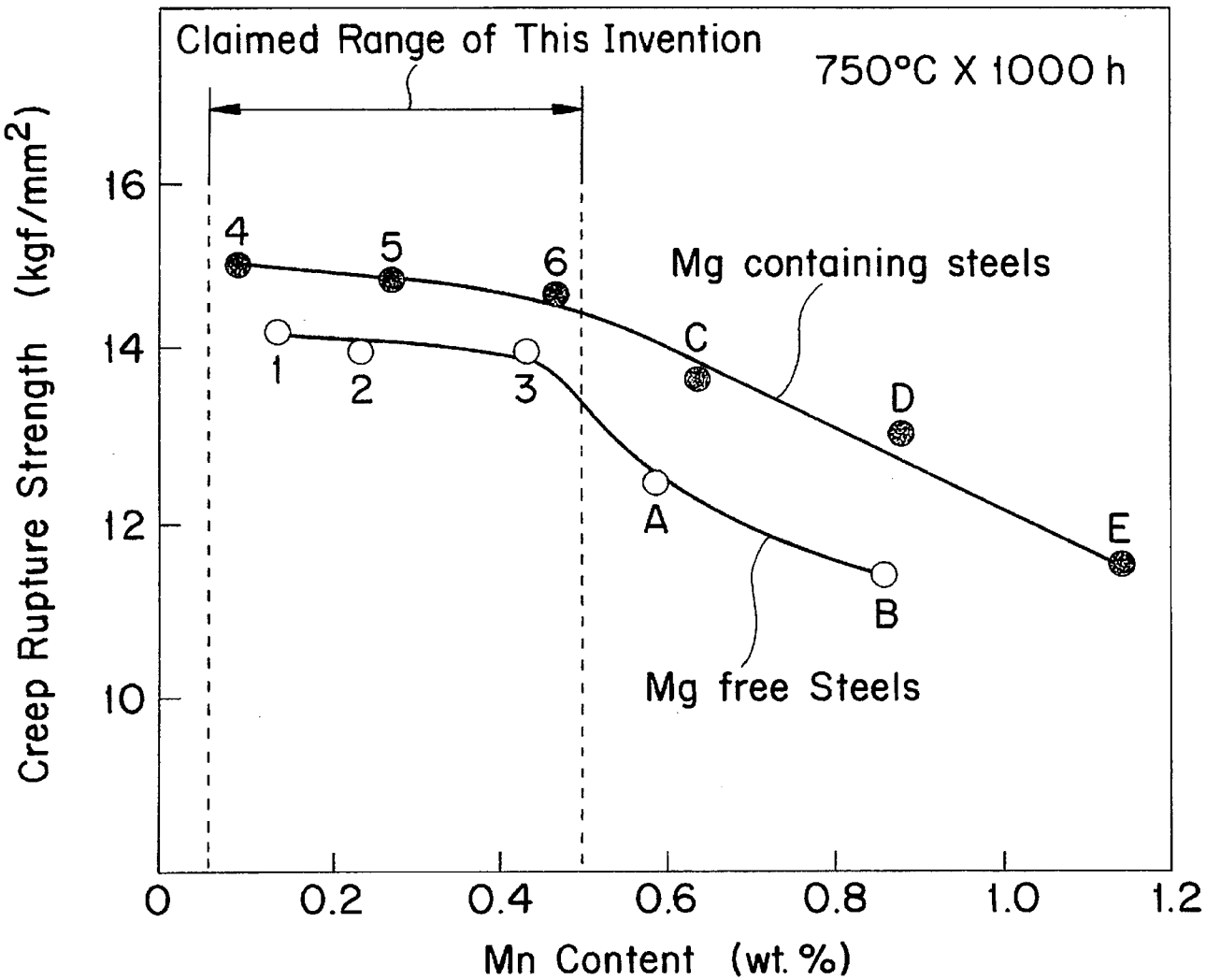
FIG. 1 shows the relationship between the manganese content and the creep rupture strength of the steel.

Hereinafter the behavior and function of each alloying element will be described in more detail as well as the technical reason for defining the content of each alloying element, wherein percent (%) represents percent by weight.

Carbon

Carbon is an element effective to ensure the necessary tensile strength and creep rupture strength of a heat resistant steel. However, more than 0.15% carbon only increases insoluble carbides in the solution treatment condition, and cannot contribute to increasing the strength at high temperatures. Furthermore, more than 0.15% carbon decreases the toughness and other mechanical properties. The carbon content is therefore defined to be not more than 0.15%.

Although the carbon content of the steel which contains considerable amounts of nitrogen can be at a fairly low level, the lower limit of the carbon content is defined as 0.05% to obtain the above-mentioned effects.

Silicon

Silicon is usually used as a deoxidizing agent of the steel. Silicon is also effective to improve oxidation resistance of the steel. However, an excess of silicon is detrimental to weldability and hot workability of the steel. In the steel of this invention which contains considerable amounts of nitrogen, excessive amounts of silicon accelerates precipitation of nitrides to reduce toughness while the steel is exposed to an aging or a creeping condition. The silicon content is therefore restricted to be not more than 0.5%; preferably to be not more than 0.3%, if higher toughness and ductility are required, more preferably the silicon content should be reduced to substantially nil or trace amounts.

Manganese

Manganese exhibits a deoxidizing effect of the steel as well as silicon, and is also effective to improve hot workability of the steel. Manganese is usually contained in ordinary austenitic stainless steel in amounts of about 1 to 2% so as to obtain said effects on the steel. However, in the steel of this invention which contains considerable amounts of copper, niobium and nitrogen, creep rupture strength at elevated temperatures for long periods of time is remarkably increased by suppressing manganese content to be not more than 0.50%, because the lowering of the manganese content suppresses growth of copper phase and NbCrN complex nitride, both of which are finely precipitated in the steel matrix during creeping.

Considering the creep rupture strength of the steel, there are no lower limits of the manganese content. However, in view of improving both the deoxidizing effect and the hot workability, the lower limit of the manganese content is restricted to 0.05%.

Chromium

Chromium is an element to improve oxidation resistance and heat resistance at elevated temperatures. These properties are increased in accordance with the increase of the chromium content. If the chromium content is less than 17%, the above-mentioned effects will not be achieved. On the other hand, if the chromium content is more than 25%, the nickel content must be increased in order to make an austenitic structure stable, thus resulting in an increase of production costs. Therefore the chromium content is restricted to a range of 17 to 25%.

Nickel

Nickel is an indispensable component for ensuring a stable austenitic structure, but the optimum amount is determined by the amounts of ferrite forming elements, such as chromium, molybdenum, tungsten and niobium, and amounts of austenite forming elements, such as, carbon and nitrogen. If the nickel content is less than 7%, it becomes difficult to obtain a stable austenitic structure, whereas if the nickel content exceeds 20%, the production cost becomes too high. Accordingly, the nickel content is restricted to a range of 7 to 20%.

Copper

Copper precipitates as a fine metallic phase in the matrix of the steel and is uniformly dispersed therein while the steel is exposed to a creeping condition, contributing to the improvement of the creep rupture strength. In order to obtain the above-mentioned effect, copper content should be no less than 2.0%. On the other hand, if the copper content exceeds 4.5%, the creep rupture ductility decreases and the workability of the steel becomes poor. The copper content is therefore defined to a range of 2.0 to 4.5%.

Nitrogen

Nitrogen, as well as carbon, is an element which effectively improves tensile strength and creep rupture strength of the steel. Less than 0.05% nitrogen content cannot fully give the above-mentioned effect. Since nitrogen has larger solid-solubility as compared with carbon, a large amount of nitrogen can dissolve in the austenitic matrix by solution treatment. Reduction of toughness due to precipitation of nitrides after aging is relatively small. However, if the nitrogen content exceeds 0.25%, toughness of the steel after aging is reduced. The nitrogen content is therefore restricted to a range of 0.05 to 0.25%.

Niobium

Niobium is an element which improves the creep rupture strength of the steel due to precipitation and dispersion hardening of fine niobium carbonitride. If the niobium content is less than 0.10%, the above-mentioned effect is not fully achieved, whereas if the niobium content exceeds 0.80%, both weldability and workability become poor and the mechanical properties are diminished by an increase of insoluble carbonitrides, which are peculiar to the nitrogen containing steel. Accordingly the niobium content is restricted to a range of 0.10 to 0.80%.

Acid Soluble Aluminum (Sol.Aluminum)

Aluminum is added to a molten steel as a deoxidizing agent, and more than 0.003% sol.aluminum should be contained in the steel in order to achieve deoxidization. However, if the residual sol.aluminum content in the steel exceeds 0.030%, precipitation of $\sigma$ phase or the other intermetallic compounds is promoted at an elevated temperature for long periods of time, resulting in a reduction of toughness. The content of sol.aluminum is therefore defined in a range of 0.003 to 0.030%, preferably 0.003 to 0.020%.

Boron

Boron contributes to increase the creep rupture strength by strengthening of austenitic matrix due to precipitation and dispersion of fine carbonitride and by strengthening the grain boundary. If the boron content is less than 0.001%, the above-mentioned effect is not fully obtained, whereas if the boron content exceeds 0.01%, the weldability becomes poor. The boron content is therefore defined in a range of 0.001% to 0.010%.

In addition to the above-mentioned components, if necessary, molybdenum or tungsten or both of them may be added to the steel of this invention. Also magnesium may be added to the steel, if needed. The technical reason for defining the content of each said optional element will hereinafter be described in detail.

Molybdenum and Tungsten

These elements serve to improve elevated temperature strength of the steel. Less than 0.3% molybdenum or less than 0.5% tungsten cannot fully achieve this effect. On the other hand, excessive amounts of molybdenum and tungsten increase cost of the steel. Furthermore, when the molybdenum content and the tungsten content exceed 3.0% and 5% respectively, the strength at elevated temperatures is no more improved and the workability of the steel is diminished. For this reason, the molybdenum content and the tungsten content are restricted to ranges of 0.3 to 2.0% and 0.5 to 4.0%, respectively.

The reason for the upper limits of the molybdenum content and the tungsten content being lower than those disclosed in the above-mentioned JPPD 62-133048 (3.0% Mo and 5.0% W) is based on the fact that the manganese content, which is effective in order to improve the workability of the steel, is suppressed to a low level in the steel of this invention.

Magnesium

Magnesium is effective to fully deoxidize the steel of this invention which contain rather small amounts of manganese and aluminum. Magnesium also contributes to improve creep rupture strength. If the magnesium content is less than 0.001%, the above-mentioned effect is scarcely attained. On the other hand, when the magnesium content exceeds 0.015%, the weldability and the workability of the steel are diminished. Therefore, when the magnesium is added to the steel, it is preferable that the content is restricted to a range 0.001% to 0.015%.

EXAMPLE

Test specimens of a series of steel composition according to this invention (alloy Nos.1 to 22) listed in Table 1 and another series of comparative steel compositions (alloy marks A to M) listed in Table 2 were prepared by vacuum melting, forging, cold-rolling and solution-treatment.

Each of these test specimens was subjected to a creep rupture test, and creep rupture strength at 750° C. for 1000 hours was estimated.

Figure 2:
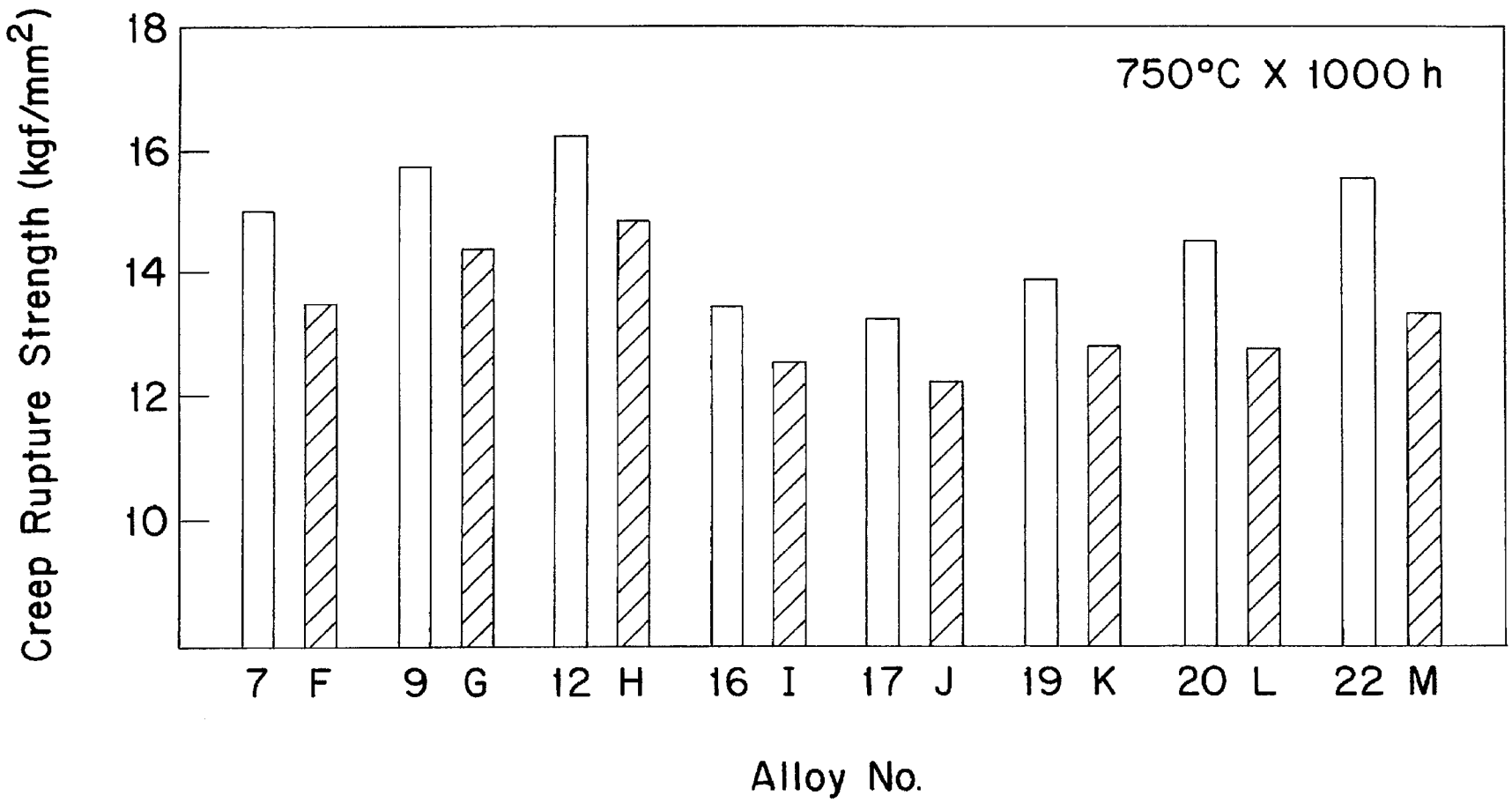
FIG. 2 shows the creep rupture strength of the steels of this invention compared to that of the comparative steels having similar chemical compositions.

The test results are set forth in Table 3, FIG. 1 and FIG. 2, respectively. FIG. 1 shows the test results regarding the test specimens (Nos.1 to 6 in Table 3) and that of the test specimens (Marks A to E in Table 3), wherein the black dots donote magnesium containing steels (4 to 6 and C to E) and white dots donote magnesium free steels (1 to 3 and A and B).

It is apparent from the test results that decreasing manganese content is very effective to improve the creep rupture strength, and particularly, that the creep rupture strength of the steels of this invention with the controlled manganese content in the claimed range is distinctively improved as compared with that of the comparative steels with the manganese contents outside the claimed range.

FIG. 2 shows the test results regarding the test specimens of Table 3 (Nos.7,9,12,16,17,19,20 and 22, and Marks F to M), as classifying the alloy compositions into eight groups and comparing some of the steels of this invention with the corresponding comparative steel. It is apparent from FIG. 3 that the creep rupture strength is remarkably improved by controlling the manganese content in the range according to this invention in each steel group.

The creep rupture strength is improved by adding magnesium to the steel as shown in FIG. 1. Furthermore, the creep rupture strength is improved by adding molybdenum (alloy No.7), tungsten (alloy No.9,22), and magnesium plus tungsten (alloy No.12) to the steel, as shown in FIG. 2.

TABLE 1

| Alloy | | Chemical Composition (weight %, The Balance being Fe and impurities) | | | | | | | | | | | | |
|---|---|---|---|---|---|---|---|---|---|---|---|---|---|---|
| | No. | C | Si | Mn | Cr | Ni | Cu | N | Nb | B | sol. Al | Mg | Mo | W |
| Steels of This Invention | 1 | 0.10 | 0.20 | 0.14 | 18.5 | 9.3 | 3.10 | 0.090 | 0.45 | 0.0035 | 0.015 | — | — | — |
| | 2 | 0.09 | 0.22 | 0.24 | 18.8 | 9.5 | 3.15 | 0.093 | 0.43 | 0.0035 | 0.011 | — | — | — |
| | 3 | 0.11 | 0.20 | 0.43 | 18.3 | 9.1 | 3.13 | 0.092 | 0.47 | 0.0040 | 0.010 | — | — | — |
| | 4 | 0.10 | 0.18 | 0.09 | 18.0 | 9.0 | 3.25 | 0.115 | 0.40 | 0.0033 | 0.016 | 0.010 | — | — |
| | 5 | 0.09 | 0.21 | 0.27 | 18.5 | 9.3 | 3.35 | 0.100 | 0.45 | 0.0038 | 0.010 | 0.009 | — | — |
| | 6 | 0.10 | 0.19 | 0.46 | 18.2 | 9.0 | 3.30 | 0.110 | 0.42 | 0.0040 | 0.010 | 0.011 | — | — |
| | 7 | 0.08 | 0.22 | 0.13 | 22.8 | 19.5 | 3.60 | 0.160 | 0.48 | 0.0035 | 0.009 | — | 0.83 | — |
| | 8 | 0.07 | 0.20 | 0.18 | 23.0 | 19.0 | 3.65 | 0.155 | 0.42 | 0.0041 | 0.015 | — | 1.86 | — |
| | 9 | 0.10 | 0.15 | 0.16 | 22.7 | 15.8 | 3.90 | 0.223 | 0.48 | 0.0038 | 0.018 | — | — | 1.60 |
| | 10 | 0.10 | 0.18 | 0.10 | 23.2 | 18.0 | 3.80 | 0.220 | 0.44 | 0.0033 | 0.010 | — | — | 3.54 |
| | 11 | 0.10 | 0.15 | 0.12 | 22.0 | 16.0 | 3.75 | 0.193 | 0.52 | 0.0038 | 0.010 | — | 0.83 | 0.75 |
| | 12 | 0.08 | 0.15 | 0.25 | 22.3 | 16.0 | 3.75 | 0.163 | 0.50 | 0.0030 | 0.008 | 0.008 | — | 1.58 |
| | 13 | 0.10 | 0.11 | 0.20 | 23.2 | 18.7 | 3.30 | 0.170 | 0.48 | 0.0050 | 0.010 | 0.007 | — | 2.50 |
| | 14 | 0.14 | 0.15 | 0.32 | 18.8 | 7.6 | 3.50 | 0.070 | 0.42 | 0.0035 | 0.013 | — | — | — |
| | 15 | 0.06 | 0.17 | 0.22 | 18.5 | 9.6 | 3.30 | 0.090 | 0.40 | 0.0085 | 0.010 | — | — | — |
| | 16 | 0.10 | 0.42 | 0.07 | 18.0 | 8.6 | 3.55 | 0.095 | 0.47 | 0.0040 | 0.011 | — | — | — |
| | 17 | 0.09 | 0.18 | 0.15 | 17.4 | 9.5 | 2.50 | 0.095 | 0.40 | 0.0020 | 0.020 | — | — | — |
| | 18 | 0.10 | 0.15 | 0.30 | 18.3 | 8.6 | 4.20 | 0.075 | 0.38 | 0.0025 | 0.012 | — | — | — |
| | 19 | 0.09 | 0.20 | 0.24 | 19.0 | 9.5 | 3.35 | 0.093 | 0.15 | 0.0040 | 0.010 | — | — | — |
| | 20 | 0.10 | 0.15 | 0.19 | 18.5 | 8.5 | 3.30 | 0.090 | 0.57 | 0.0030 | 0.015 | — | — | — |
| | 21 | 0.09 | 0.13 | 0.22 | 22.5 | 18.3 | 3.55 | 0.168 | 0.47 | 0.0038 | 0.008 | — | — | 1.58 |
| | 22 | 0.10 | 0.19 | 0.16 | 23.0 | 15.5 | 3.50 | 0.220 | 0.48 | 0.0040 | 0.013 | — | — | 1.75 |

TABLE 2

| Alloy | | Chemical Composition (weight %, The Balance being Fe and impurities) | | | | | | | | | | | | |
|---|---|---|---|---|---|---|---|---|---|---|---|---|---|---|
| | No. | C | Si | Mn | Cr | Ni | Cu | N | Nb | B | sol. Al | Mg | Mo | W |
| Comparative Steels | A | 0.10 | 0.20 | *0.59 | 18.5 | 9.3 | 3.10 | 0.090 | 0.45 | 0.0035 | 0.015 | — | — | — |
| | B | 0.09 | 0.22 | *0.86 | 18.8 | 9.5 | 3.15 | 0.093 | 0.43 | 0.0035 | 0.011 | — | — | — |
| | C | 0.10 | 0.18 | *0.63 | 18.0 | 9.0 | 3.25 | 0.115 | 0.40 | 0.0033 | 0.016 | 0.010 | — | — |
| | D | 0.09 | 0.21 | *0.88 | 18.5 | 9.3 | 3.35 | 0.100 | 0.45 | 0.0038 | 0.010 | 0.009 | — | — |
| | E | 0.10 | 0.19 | *1.14 | 18.2 | 9.0 | 3.30 | 0.110 | 0.42 | 0.0040 | 0.010 | 0.011 | — | — |
| | F | 0.08 | 0.22 | *0.78 | 22.8 | 19.5 | 3.60 | 0.160 | 0.48 | 0.0035 | 0.009 | — | 0.083 | — |
| | G | 0.10 | 0.15 | *0.85 | 22.7 | 15.8 | 3.90 | 0.223 | 0.48 | 0.0038 | 0.018 | — | — | 1.60 |
| | H | 0.08 | 0.15 | *0.95 | 22.3 | 16.0 | 3.75 | 0.163 | 0.50 | 0.0030 | 0.008 | 0.008 | — | 1.58 |
| | I | 0.10 | 0.42 | *0.70 | 18.0 | 8.6 | 3.55 | 0.095 | 0.47 | 0.0040 | 0.011 | — | — | — |
| | J | 0.09 | 0.18 | *0.65 | 17.4 | 9.5 | 2.50 | 0.095 | 0.40 | 0.0020 | 0.020 | — | — | — |
| | K | 0.09 | 0.20 | *0.73 | 19.0 | 9.5 | 3.35 | 0.093 | 0.15 | 0.0040 | 0.010 | — | — | — |
| | L | 0.10 | 0.15 | *0.63 | 18.5 | 8.5 | 3.30 | 0.090 | 0.57 | 0.0030 | 0.015 | — | — | — |
| | M | 0.10 | 0.19 | *1.08 | 23.0 | 15.5 | 3.50 | 0.220 | 0.48 | 0.0040 | 0.013 | — | — | 1.75 |

(Note)*: Outside of the Claimed Range of This Invention

TABLE 3

| Alloy | No. | Creep Rupture Strength at 750° C., 1000 hr (kgf/mm²) | Alloy | No. | Creep Rupture Strength at 750° C., 1000 hr (kgf/mm²) |
|---|---|---|---|---|---|
| Steels of This Invention | 1 | 14.2 | Comparative steels | A | 12.5 |
| | 2 | 14.0 | | B | 11.4 |
| | 3 | 14.0 | | C | 13.6 |
| | 4 | 15.0 | | D | 13.0 |
| | 5 | 14.9 | | E | 11.5 |
| | 6 | 14.7 | | F | 13.5 |
| | 7 | 15.0 | | G | 14.4 |
| | 8 | 16.2 | | H | 14.9 |
| | 9 | 15.8 | | I | 12.6 |
| | 10 | 17.3 | | J | 12.3 |
| | 11 | 16.0 | | K | 12.9 |
| | 12 | 16.3 | | L | 12.9 |
| | 13 | 16.8 | | M | 13.5 |
| | 14 | 14.5 | | | |
| | 15 | 13.7 | | | |
| | 16 | 13.5 | | | |
| | 17 | 13.3 | | | |
| | 18 | 14.6 | | | |
| | 19 | 14.0 | | | |
| | 20 | 14.6 | | | |
| | 21 | 14.6 | | | |
| | 22 | 15.7 | | | |

The resultant steel of this invention has excellent strength and at elevated temperatures and exhibits improved creep rupture strength at higher temperatures for long periods of time. Since nitrogen replaces nickel, the resultant steel can be produced at low cost. The steel is suitable for use in the structural members for boilers, chemical plants and other installations which are operated in a high temperature environment.

Although this invention has been shown and described with respect to a preferred embodiment thereof, it should be understood by those skilled in the art that various changes and modifications in the details thereof may be made therein and thereto without departing from the spirit and scope of the invention.

What is claimed is:

1. A heat resistant austenitic stainless steel having high strength at elevated temperatures, consisting essentially of, on the weight percent basis, 0.05 to 0.15% carbon, not more than 0.3% silicon, 0.05 to 0.50% manganese, 17 to 25% chromium, 7 to 20% nickel, 2.0 to 4.5% copper, 0.10 to 0.80% niobium, 0.001 to 0.010% boron, 0.05 to 0.25% nitrogen, 0.003 to 0.030% sol. aluminum and the balance being iron and incidental impurities.

2. A heat resistant austenitic stainless steel having high strength at elevated temperatures, consisting essentially of, on the weight percent basis, 0.05 to 0.15% carbon, not more than 0.5% silicon, 0.05 to 0.50% manganese, 17 to 25% chromium, 7 to 20% nickel, 2.0 to 4.5% copper, 0.10 to 0.80% niobium, 0.001 to 0.010% boron, 0.05 to 0.25% nitrogen, 0.003 to 0.030% sol. aluminum, one or both of 0.5%<Mo≦2.0% and 0.5 to 4.0% tungsten, the molybdenum and/or tungsten being present in an amount effective to improve elevated temperature strength, and the balance being iron and incidental impurities.

3. A heat resistant austenitic stainless steel having high strength at elevated temperatures, consisting essentially of, on the weight percent basis, 0.05 to 0.15% carbon, not more than 0.5% silicon, 0.05 to 0.50% manganese, 17 to 25% chromium, 7 to 20% nickel, 2.0 to 4.5% copper, 0.10 to 0.80% niobium, 0.001 to 0.010% boron, 0.05 to 0.25% nitrogen, 0.003 to 0.030% sol. aluminum, 0.001 to 0.015% magnesium, and the balance being iron and incidental impurities.

4. A heat resistant austenitic stainless steel having high strength at elevated temperatures, consisting essentially of, on the weight percent basis, 0.05 to 0.15% carbon, not more than 0.5% silicon, 0.05 to 0.50% manganese, 17 to 25% chromium, 7 to 20% nickel, 2.0 to 4.5% copper, 0.10 to 0.80% niobium, 0.001 to 0.010% boron, 0.05 to 0.25% nitrogen, 0.003 to 0.030% sol. aluminum, 0.001 to 0.015% magnesium, one or both of 0.3 to 2.0% molybdenum and 0.5 to 4.0% tungsten, and the balance being iron and incidental impurities.

5. The heat resistant austenitic stainless steel of claim 1, wherein the steel comprises a structural member of a boiler.

6. The heat resistant austenitic stainless steel of claim 2, wherein the steel comprises a structural member of a boiler.

7. The heat resistant austenitic stainless steel of claim 3, wherein the steel comprises a structural member of a boiler.

8. The heat resistant austenitic stainless steel of claim 4, wherein the steel comprises a structural member of a boiler.

9. The heat resistant austenitic stainless steel of claim 1, wherein the steel exhibits a creep rupture strength at 750° C. for 1000 hours of at least 13.3 kgf/mm².

10. The heat resistant austenitic stainless steel of claim 2, wherein the steel exhibits a creep rupture strength at 750° C. for 1000 hours of at least 13.3 kgf/mm².

11. The heat resistant austenitic stainless steel of claim 3, wherein the steel exhibits a creep rupture strength at 750° C. for 1000 hours of at least 13.3 kgf/mm².

12. The heat resistant austenitic stainless steel of claim 4, wherein the steel exhibits a creep rupture strength at 750° C. for 1000 hours of at least 13.3 kgf/mm².

* * * * *